United States Patent [19]

Craig

[11] Patent Number: 4,572,595

[45] Date of Patent: Feb. 25, 1986

[54] ROTATIONAL SHELF APPARATUS

[76] Inventor: Chapman C. Craig, 2228 Houser Rd., Knoxville, Tenn. 37919

[21] Appl. No.: 600,083

[22] Filed: Apr. 13, 1984

[51] Int. Cl.[4] ..... A47B 11/00; A47F 3/10

[52] U.S. Cl. ..... 312/305; 312/125; 312/135; 312/252; 108/141; 211/144

[58] Field of Search ..... 312/305, 125, 135, 238, 312/202, 11, 97.1, 197, 252; 108/141; 211/144; 248/546

[56] References Cited

U.S. PATENT DOCUMENTS

| | | | |
|---|---|---|---|
| 2,527,132 | 10/1950 | Jackson et al. | 312/305 |
| 2,638,969 | 5/1953 | Restivo | 108/141 |
| 2,777,585 | 1/1957 | Jorgensen | 211/144 |
| 2,831,582 | 4/1958 | Cody | 108/141 |
| 3,019,912 | 2/1962 | Hoffman | 211/144 |
| 3,088,787 | 5/1963 | Perkins | 312/305 |
| 3,127,994 | 4/1964 | Campbell | 211/144 |
| 3,982,800 | 9/1976 | Gorton et al. | 312/135 |
| 4,181,037 | 1/1980 | Boon et al. | 312/238 |
| 4,418,970 | 12/1983 | Hyder et al. | 312/125 |
| 4,433,885 | 2/1984 | Baker | 312/125 |

FOREIGN PATENT DOCUMENTS

| | | | |
|---|---|---|---|
| 803415 | 4/1951 | Fed. Rep. of Germany | 211/144 |

*Primary Examiner*—Victor N. Sakran
*Attorney, Agent, or Firm*—Pitts and Brittian

[57] ABSTRACT

A rotational shelf apparatus (10) for being rotatably mounted in a cabinet or other storage area having a ceiling surface (14) and a floor surface (16). The apparatus (10) comprises a rotating support shaft (22) having first and second end portions (24) and (26), respectively, the support shaft (22) being provided with a coaxial hole (38) at its first end portion (24) for slidably receiving a spring member (42). The second end portion (26) of the support shaft (22) is provided with means for rotatably engaging the floor surface of the cabinet or storage area. The apparatus (10) further comprises a stationary support rod (44) having first and second end portions (51) and (52), respectively, the second end portion (52) being slidably received in the coaxial hole (38) of the support shaft (22) in telescoping fashion such that the second end portion (52) of the support rod (44) releasably engages the first end portion (46) of the spring member (42) thus, biasing the support rod (44) in the direction of the ceiling surface of the cabinet. The first end portion (51) of the support rod (44) is provided with means for releasably engaging the ceiling surface (14) of the cabinet (12). At least one support structure is mounted on the rotating support shaft (22), this support structure, in one embodiment, comprising a shelf member (20), and in another embodiment comprises a hanger rack. Further, in one preferred embodiment the apparatus (10) is provided with a homing assembly (84) for releasably holding the rotating support shaft (22) at at least two preselected rotational position.

19 Claims, 7 Drawing Figures

ROTATIONAL SHELF APPARATUS

DESCRIPTION

1. Technical Field

This invention relates to a rotational shelf apparatus for being releasably mounted in a cabinet or other storage area having ceiling and floor surfaces to serve as installation surfaces. More specifically the invention relates to revolving shelves of the lazy susan type.

2. Background Art

It has become common to install rotary cabinet units, known as "Lazy Susan" units in storage areas such as cabinets in kitchens. This type of shelving has been of considerable utility due to the fact that the rotary cabinet units create the ability to use areas of the cabinets that would otherwise be wasted or hard to access. However, in the past these rotary shelf units have proven to be difficult to install, and such installation normally requires considerable carpentry or mechnical skills along with various tools for applying such skills. The present apparatus facilitates quick, convenient positioning in a cabinet storage area without requiring permanent attaching fixtures for secure installation. The present apparatus further affords rapid, simple adjustment to compensate for movements of vertical positioning necessitated by inadequate implantation or case stress resulting from load weight or movement of different component materials (such as plastic particle board, plywood, lumber, etc.) according to changes in moisture or temperature. Examples of various rotating shelf devices are disclosed in the following U.S. Pat. Nos.

| U.S. PAT. NO. | ISSUED TO | DATE |
|---|---|---|
| 2,527,132 | H. T. Jackson, et al. | October 21, 1950 |
| 3,019,912 | A. R. Hoffman | February 6, 1962 |
| 3,127,994 | H. E. Campbell | April 7, 1964 |
| 3,982,800 | H. B. Gorton, et al. | September 28, 1976 |
| 4,418,970 | M. W. Hyder, et al. | December 6, 1983 |

It will be noted that in the case of each of the above referenced patents various tools are necessary for installation, holes must be measured to assure proper vertical alignment and drilled to receive various fasteners, and should an error be made in the initial installation the whole procedure must be repeated. Further, should it become desirable to relocate the revolving shelf tools are required to remove the shelf and the complicated installation procedure repeated for installation in the new location. A releasably mounted rotary shelf unit requiring no tools or fasteners for installation is disclosed in U.S. Pat. No. 2,831,582 issued to J. B. Cody on April 22, 1958. However, the Cody unit is not designed to support a door panel for closing an associated cabinet, and no provision is made for homing the shelf members to a preselected rotational position.

Therefore it is an object of the present invention to provide a rotating shelf apparatus which can be releasably mounted in a cabinet or other storage area without requiring any special mechanical or carpentry skills.

It is another object of the present invention to provide a rotational shelf apparatus which may be releasably installed without the necessity of tools.

Another object of the present invention is to provide a rotational shelf apparatus which will support a door panel for closing an associated cabinet or storage area.

Yet another object of the present invention is to provide a rotating shelf apparatus featuring a homing assembly for holding the shelf members in a preselected rotational position.

Another object of the present invention is to provide a rotational shelf apparatus which is inexpensive to manufacture and maintain.

DISCLOSURE OF THE INVENTION

Other objects and advantages will be accomplished by the present invention which provides a rotational shelf apparatus for being mounted in a cabinet or other storage area having installation surfaces comprising a ceiling surface and a floor surface. The apparatus comprises a rotating support shaft having upper and lower end portions, the support shaft being provided with a coaxial hole at its upper end portion for slidably receiving and housing a spring member. The lower end portion of the support shaft is provided with means for rotatably engaging the floor surface of the cabinet or storage area. The apparatus further comprises a stationary support rod having upper and lower end portions, the lower end portion of the support rod being slidably received in the hole in the upper end portion of the support shaft in telescoping fashion such that the lower end portion of the support rod releasably engages the spring member such that the spring member serves to bias the support rod in the direction of the ceiling surface of the cabinet or storage area. The upper end portion of the support rod is provided with means for releasably engaging the ceiling surface of the cabinet or other storage area, these means comprising a cap member provided with a suitable engaging surface for engaging the ceiling surface. The apparatus is provided with at least one shelf member engaged to the rotating support shaft such that the shelf member rotates with the rotating support shaft, and in one embodiment the apparatus comprises at least a pair of support shelves which in turn support a door panel which serves as a closure for the cabinet or storage area. Further, in one preferred embodiment the apparatus is provided with a homing assembly for releasably holding the shelf members at a preselected rotational position.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
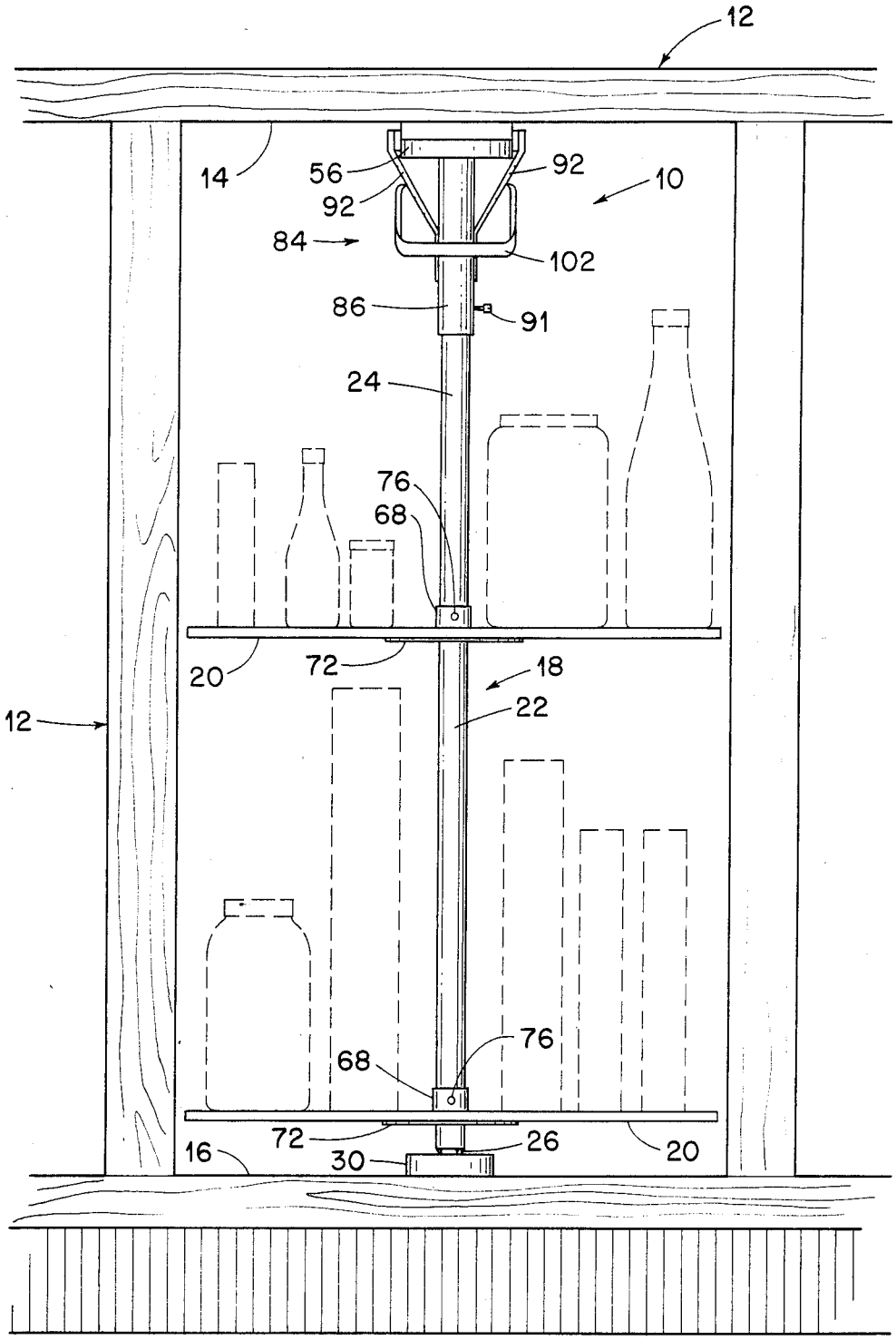
FIG. 1 illustrates a side elevation view of the rotational shelf apparatus of the present invention.

A rotational shelf apparatus incorporating various features of the present invention is illustrated generally at 10 in FIG. 1. The shelf apparatus 10 is adapted for being releasably mounted in a cabinet 12 having installation surfaces comprising a ceiling surface 14 and a floor surface 16. However, it will be appreciated that the use of the apparatus 10 is not confined to use within a cabinet and the apparatus 10 can be adapted for releasable mounting in various storage areas having the requisite installation surfaces. Further, it will be understood that whereas the apparatus 10 has been entitled a rotational shelf apparatus, the term "shelf" as used herein encompasses various support structures for supporting items to be stored.

Figure 2:
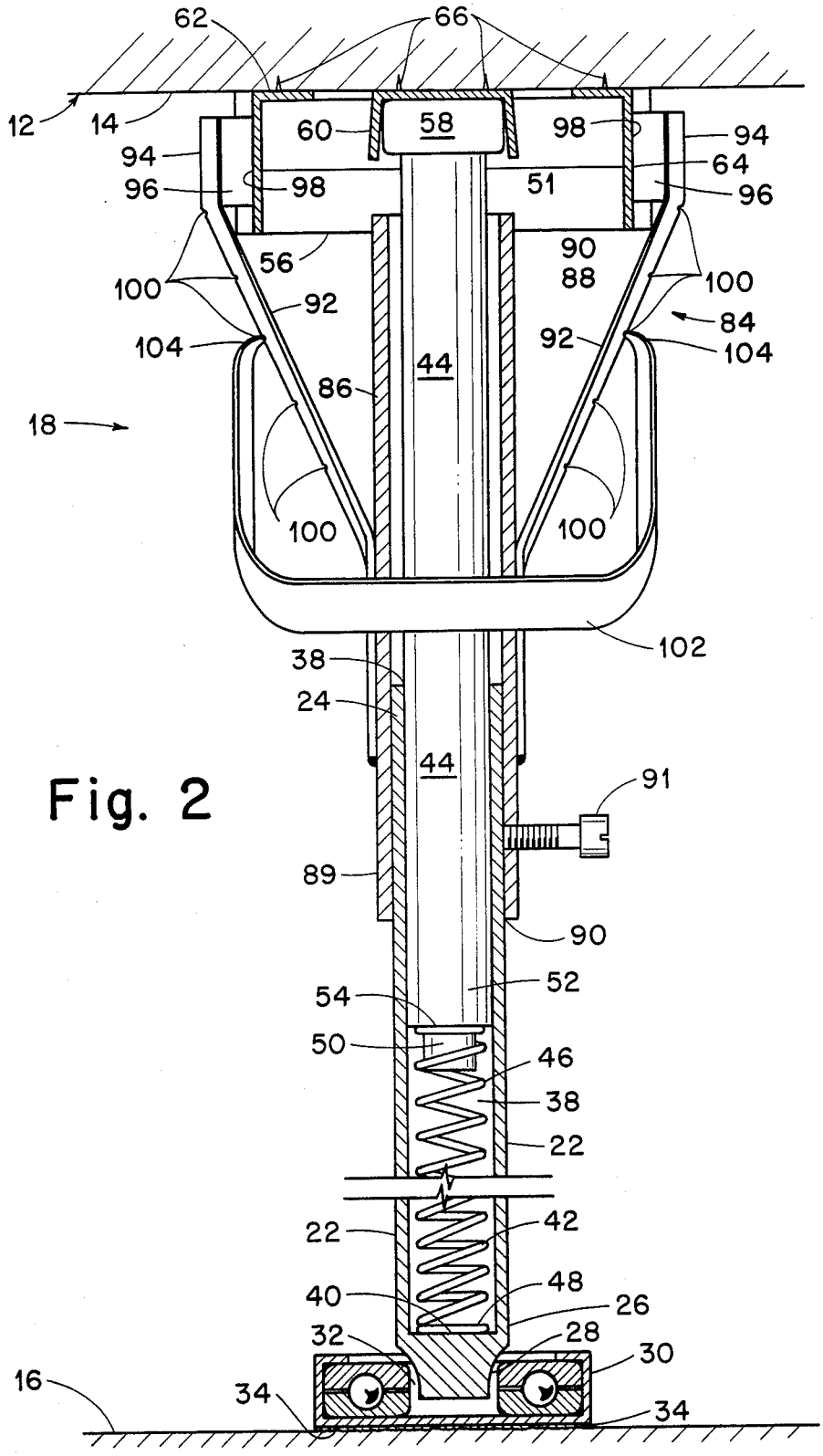
FIG. 2 illustrates a side elevation view, in section, of the support assembly of the rotational shelf apparatus of the present invention.
Figure 3:
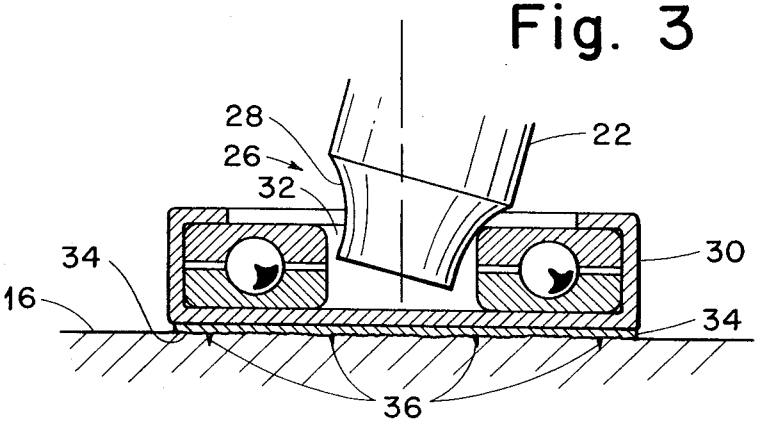
FIG. 3 illustrates a side elevation view, partially in section, of the lower end portion of the support shaft of the present invention and the bearing member of the present invention.

As is best illustrated in FIGS. 1 and 2 the apparatus 10 comprises a support assembly 18 for rotatably mounting adjustable shelf members 20. The support assembly 18 includes a rotational support shaft 22 provided with upper and lower end portions 24 and 26, respectively, the lower end portion 26 having a decreasing cross sectional diameter circumferentially defining an arcuate engaging surface 28. A bearing member 30 is provided for rotatably receiving and supporting the lower end portion 26 of the shaft 22 upon the floor surface 16. In this regard, the bearing member 30 is provided with an annular receptor 32 for receiving the lower end portion 26 of the shaft 22 such that the bearing member 30 engages the arcuate engaging surface 28. As illustrated in FIG. 3 the arcuate surface 28 facilitates the free rotation of the shaft 22 even where the shaft 22 is preferred out of vertical alignment. It will be appreciated that FIG. 3 represents an exaggerated illustration of the misalignment of the rotating shaft 22, but is demonstrative of the fact that, whereas precise vertical alignment is desirable, the apparatus 10 will continue to provide for rotation of the shelf members 20 even where the shaft 22 is not in the precise vertical alignment.

The bearing member 30 further comprises a lower engaging surface 34 for releasably engaging the floor surface 16. Preferably the surface 34 is fabricated of a friction producing material such as a material that defines an abrasive surface, or a rubber-like material, such that lateral movement of the bearing member 30 is prohibited. Further, in one embodiment the engaging surface 34 is provided with a plurality of engaging teeth 36 which implant themselves into the floor surface 16 to prohibit lateral movement of the bearing member 30.

Continuing with regard to the rotating support shaft 22, the shaft 22 is provided at its upper end portion 24 with a coaxial hole 38 extending substantially the length of the support shaft 22 and terminating in an interior support surface 40. The hole 38 is slidably and rotatably receptive of a spring member 42 and a stationary support rod 44. The spring member 42 is provided with first and second end portions 46 and 48, respectively, the second end portion 48 engaging the interior support surface 40. The first end portion 46 of the spring member 42 is provided with a spring terminal 50 which engages lower end portion 52 of the stationary support rod 44. In the preferred embodiment the spring terminal 50 is fabricated of a strong durable material capable of providing and maintaining friction reducing surfaces. In this regard the terminal 50 defines an upper surface 54 which facilitates the friction free rotation of the terminal 50 with respect to the stationary support rod 34. Of course, the spring member 42 is free to rotate within the support shaft 22, but it will be appreciated that the surface 54 further ensures the free rotation of the rotating support shaft 22 with respect to the stationary support rod 44.

The support assembly 18 further comprises a cap member 56 mounted on the upper end portion 51 of the support rod 44. In this regard the upper end portion 51 of the support rod 44 is provided with a head portion 58 defining a square cross section, and the cap member 56 is provided with a mounting receptor 60 releasably receptive of the head portion 58 such that the cap member 56 can be releasably mounted on the upper end portion 51 of the rod 44. It will, of course, be appreciated that the cap member 56 can be fixedly engaged to or integrally formed with the rod 44 if desired. Further, as is best illustrated in FIG. 2, the cap member 56 is provided with an upper engaging surface 62 for engaging the ceiling surface 14 of the cabinet 12, and annular side walls defining an annular camming surface 64, the camming surface 64 being discussed in detail below. It will be appreciated that the spring member 42 serves to bias the support rod 44 and the cap member 56 upwardly such that the engaging surface 62 is forced against the ceiling surface 14. To ensure the stable positioning of the apparatus 10 within the cabinet 12 the cap member 56 is provided with a plurality of engaging teeth 66 which, as a result of the upward spring bias, implant themselves into the ceiling surface 14, thus holding the cap member 56 in a stationary position with respect to the the ceiling surface 14. However, whereas the engaging teeth 66 are of sufficient size to prohibit lateral movement of the cap member 56 during normal operation of the apparatus 10, in the preferred embodiment the teeth 66 are sufficiently small to allow the cap member 56 to be manually disengaged from the ceiling surface 14 with relatively little physical effort and without the use of tools.

Figure 4:
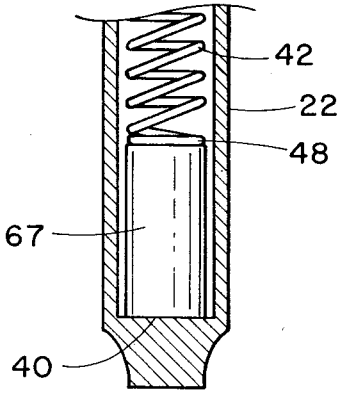
FIG. 4 illustrates a side elevation view of a portion of the support assembly of the rotational shelf apparatus of the present invention.

In light of the above it will be appreciated that the support assembly 18 can be easily installed within the cabinet 12, or other storage area, with little effort and without the necessity of tools. In this regard the bearing member 30 is positioned in the desired location on the floor surface 16 within the cabinet 12 and lower end portion 26 of the rotating shaft 22 is inserted into the annular receptor 32. The cap member 56 and the support rod 44 are then pulled downwardly to overcome the spring bias provided by the spring member 42 until the support assembly is vertically, or substantially vertically, aligned, whereupon the cap member 56 and the rod 44 are released so as to engage the ceiling surface 14. Thus it is not necessary to measure or drill holes in the cabinet for screws or other fasteners, and if the first installation effort is unsatisfactory, adjustment to the vertical alignment or position within the cabinet can be easily made. Further, it may be desirable to increase the force of the upward spring bias to provide for a more secure installation or to facilitate installation in a larger cabinet or storage area. In such event one or more extension members 67 can be placed between the spring member 42 and the interior support surface 40 of the shaft 22 as is illustrated in FIG. 4.

Figure 5:
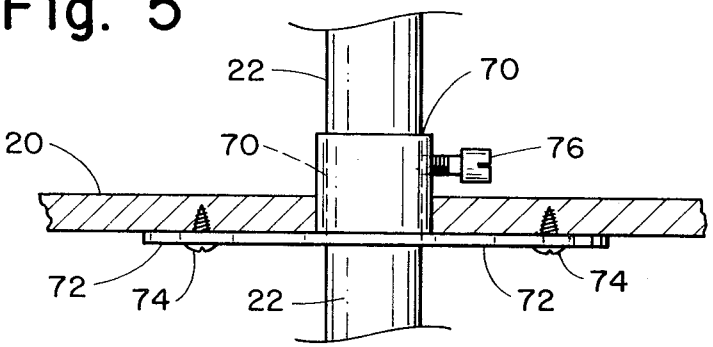
FIG. 5 illustrates a side elevation view, partially in section, of a portion of the shelf members of the present invention.

As indicated above the support assembly 18 rotatably supports adjustable shelf members 20. Accordingly, each shelf member 20 is provided with an adjustable collar 68 having a coaxial hole 70 slidably receptive of the rotating support shaft 22 (See FIG. 5). The collar 68 is provided with a support flange 72 for supporting the shelf member 20, with the screws 74, or other similar fastener means, being provided to secure the collar 68 to the shelf member 20. Thus, the collar 68 allows the shelf members 20 to be slidably positioned to a desired location along the vertical axis of the rotating shaft 22. As illustrated each collar member 68 is provided with a set screw 76 for securing the associated shelf member 20 at the desired position on the shaft 22. The shelf members being thusly secured, it will be appreciated that the shelf members 20 rotate with the shaft 22 to provide rotating access to the total shelf surface. It will also be appreciated that the shelf members 20 can be fabricated to defined various geometric configurations and can be provided with door panels such that rotation of the shelf members 20 to a preselected position results in the door panels aligning with front of an associated cabinet thus closing off access to the interior of such cabinet. For example, in FIG. 7 the shelf members 20A are semicircular in configuration and are provided with a forward edge 78 for engaging and supporting a door panel 80. As is further illustrated in FIG. 7, the shelf members 20B are adapted for corner cabinets and are provided with perpendicular forward edges 79A and 79B for engaging L-shaped door panels 82.

Figure 7:
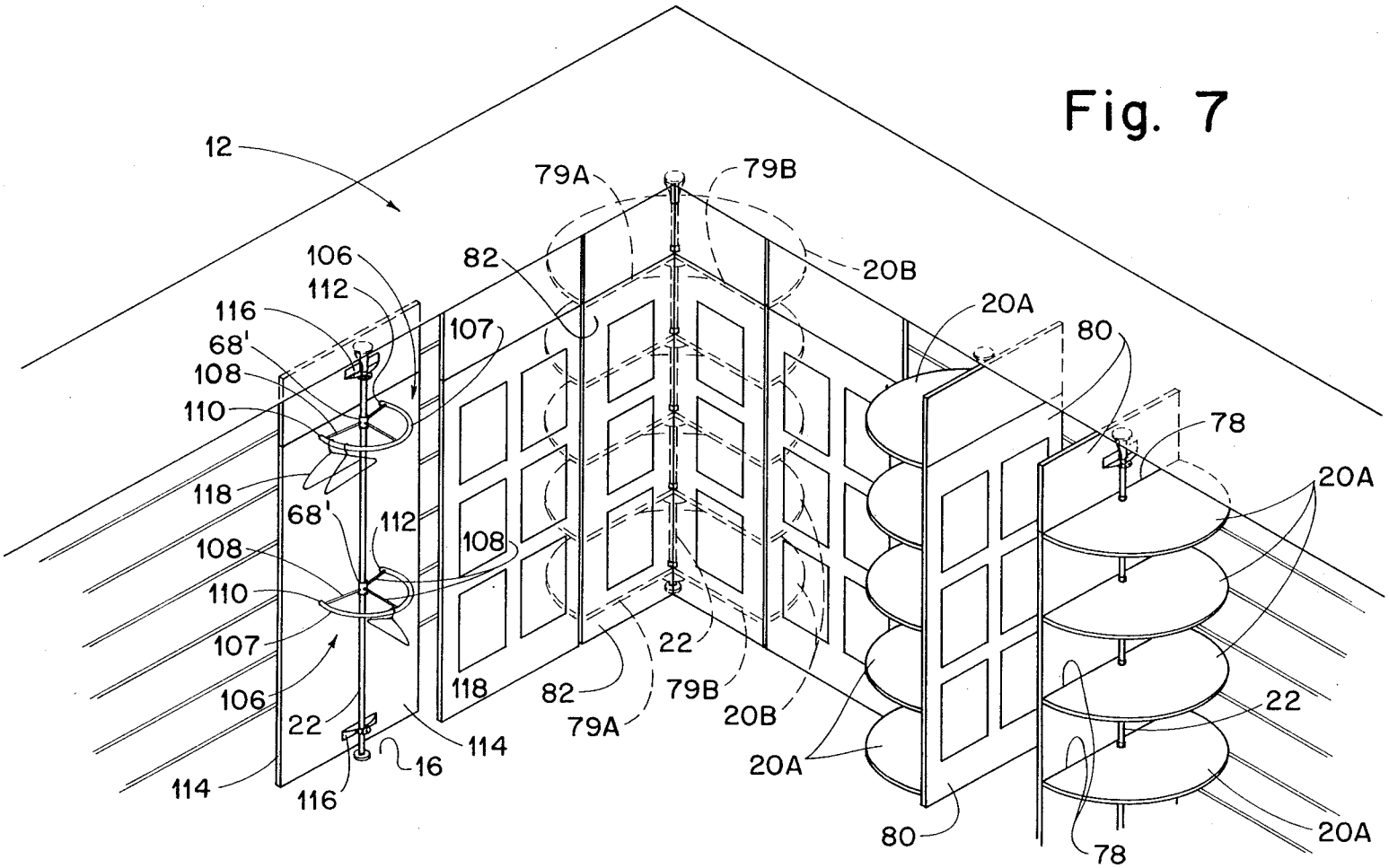
FIG. 7 illustrates a perspective view of various alternative embodiments of the rotational shelf apparatus of the present invention.

In an alternate embodiment of the apparatus 10 also illustrated in FIG. 7, an alternate support structure is mounted on the shaft 22 for releasably and rotationally supporting clothing or other items for which hanging may be a desirable storage method. This alternate support structure comprises a hanger rack 106 having an annular hanger rod 107 supported by spoke members 108, the spoke members 108 supportively radiating from an adjustable collar 68'. As with the collar 68 of the previous embodiments, the collar 68' engages the support shaft 22 such that it, and the hanger rod 107 which it supports, rotates with the shaft 22. The hanger rod 107 is provided with first and second outboard end portions 110 and 112, respectively, the end portions 110 and 112 engaging a door panel 114. In order to further secure the door panel 114 in position with respect to the hanger 106, yoke members 116 can be provided for securing the door panel 114 directly to the support shaft 22. Thus, it will be appreciated that the hanger rack 106 is releasably receptive of the hangers 118 for hanging clothing and/or other items.

Figure 6:
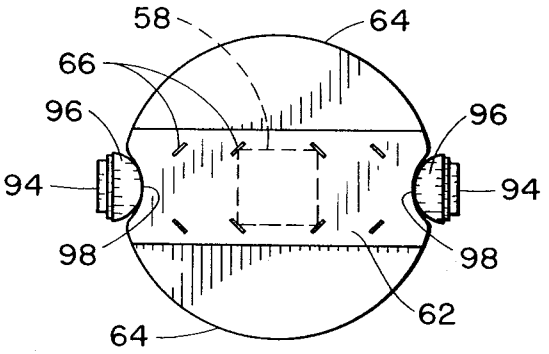
FIG. 6 illustrates a top view of the cap member of the rotational shelf apparatus of the present invention.

As illustrated in FIGS. 1, 2 and 6, in the preferred embodiment the apparatus 10 further comprises a homing assembly 84 for releasably holding the shelf members 20 (or the hanger racks 106) in one or more preselected rotational positions. For example, in the case of the shelf members 20A and 20B it may be desirable to restrict the free rotation of the shaft 22 and the shelf members 20A and 20B to the extent that the door panels 80 and 82 are releasably held in a closed position until such time as force is exerted to rotate the associated shelf members 20A and 20B in order to gain access to items on such rotating shelves. The homing assembly 84 comprises a sleeve member 86 having a first and second end portions 88 and 89, respectively, and defining a coaxial hole 90 therethrough. As illustrated in FIG. 2 the hole 90 is slidably receptive of the upper end portion 24 of the rotating support shaft 22 with a set screw 91 being provided for adjustably securing the sleeve member 86 to the rotating support shaft 22 such that it rotates with the shaft 22. Of course, while the set screw 91 is provided for securing the axial position of the sleeve member 86 in the illustrated embodiment, various other fastening means can be used to accomplish this function, or the sleeve member 86 can be integrally formed with or fixedly secured to the shaft 22 if adjustability is not desired.

The homing assembly 84 further comprises a pair of spring support members 92 secured to and oppositely disposed upon the sleeve member 86. In the illustrated embodiment the spring support members 92 are secured to the sleeve member 86 by welding, but it will be appreciated that other suitable fastening means may be used. Each of the spring support members 92 comprises an outboard end portion 94, each outboard end portion 94 carrying a cam feeler 96. The spring support members 92 inwardly spring bias the cam feelers 96 such that as the shaft 22 and the sleeve member 86 are rotated the cam feelers 96 ride along the camming surface 64 of the cap member 56. As illustrated in FIG. 6, the camming surface 64 defines a pair of oppositely disposed recesses 98 such that when the cam feelers 96 are received in the recesses 98 the rotational position of the shaft 22 and the shelf members 20 is maintained until sufficient rotational force is applied to overcome the inward spring bias of the spring support members 92. Of course, it will be appreciated that other number of recesses 98 can be provided in the cap member 56 should it be desirable to have the shelf members 20 releasably hold at more than one rotational position.

In the preferred embodiment of FIG. 2, the spring support members 92 are each provided with a plurality of recessed portions 100, and the homing assembly 84 further comprises a spring clamp 102 having oppositely disposed outboard end portions 104. As illustated, each of the end portions 104 is received in a recessed portion 100 of one of the spring support members 92 so as to further inwardly bias the members 92. It will thus be appreciated that the closer the spring clamp 102 is positioned to the cam feelers 96 the stronger the inward bias of the cam feelers 96 and the more rotational force necessary to overcome such biasing in order to rotate the shelf members 20. This ability to increase the inward biasing of the spring support members 92 and thus the cam feelers 96 is particularly important in restraining the free rotation of the shelf members 20 at a preselected position when the shelf members are carrying a heavy cargo load since a greater biasing force is necessary to overcome the greater rotational momentum generated by a heavy cargo load. It should be noted at this point that in most prior art rotating shelf devices, the rotational pivot points for the rotating support shaft are proximate the ceiling surface 14 and the floor surface 16, making it difficult to provide efficient homing devices. However, in the apparatus 10, the rotational pivot points are proximate the lower end portion 52 of the rod 44 and the lower end portion 26 of the support shaft 22, leaving the upper portion of the assembly 18 free for mounting the homing assembly 84. It will also be appreciated that removal of the upper pivot point from the upper portion of the assembly 18 makes proper vertical alignment of the apparatus 10 less critical to the operation of the apparatus 10.

In light of the above it will be appreciated that the apparatus 10 provides a rotational shelf apparatus which can be easily installed in a cabinet or other storage area without the necessity of tools. Further, whereas precise vertical alignment is not a requisite to the proper functioning of the apparatus 10, adjustment to the vertical alignment of the apparatus 10 can be easily and quickly accomplished, also without the aid of tools. The apparatus 10 also provides a homing feature which releasably restricts rotational movement of the shelf members or the other support structures of the apparatus 10 at preselected positions.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A rotational shelf apparatus for being releasably mounted in a cabinet or other storage area, said cabinet or other storage area being provided with first and second facing installation surfaces, said apparatus comprising:

a rotating support shaft having first and second end portions, said support shaft being provided with a coaxial hole at said first end portion defining a spring housing for slidably receiving a spring member, said spring member comprising first and second end portions, said second end portion of said support shaft being provided with means for rotatably engaging said second installation surface of said cabinet or other storage area, said means comprising a bearing member provided on one face with a receptor for rotatably receiving said second end portion of said support shaft, said bearing member also being provided on an opposite face with a friction producing surface for releasable engagement with said second installation surface to hold said bearing member in a preselected position on said second installation surface;

a stationary support rod having first and second end portions, said second end portion of said support rod being slidably received in said hole of said first end portion of said support shaft in telescoping fashion such that said second portion of said support rod releasably engages said first end portion of said spring member, said spring member serving to bias said support rod in the direction of said first installation surface of said cabinet or other storage area, said first end portion of said support rod being provided with means for releasably engaging said first installation surface; and at least one support structure mounted on said rotating support shaft.

2. The rotational shelf apparatus of claim 1 wherein said second end portion of said support shaft comprises a portion having a decreasing cross sectional diameter circumferentially defining an arcuate engaging surface for engaging said bearing member.

3. The rotational shelf apparatus of claim 1, wherein said friction producing surface of said bearing member is a plurality of engaging teeth for implanting in said second installation surface to hold said bearing member in said preselected position on said second installation surface.

4. The rotational shelf apparatus of claim 1 wherein said means for releasably engaging said first installation surface comprises a cap member mounted on said first end portion of said support rod, said cap member being provided with said engaging surface for releasably engaging said first installation surface.

5. The rotational shelf apparatus of claim 4 wherein said cap member further comprises a mounting receptor for releasably receiving said first end portion of said support rod such that said cap member is releasably mounted on said support rod.

6. The rotational shelf apparatus of claim 4 wherein said engaging surface of said cap member is provided with a plurality of engaging teeth for implanting in said first installation surface to hold said cap member in a preselected position on said first installation surface.

7. The rotational shelf apparatus of claim 4 wherein said cap member further comprises annular side walls defining a camming surface, said camming surface being provided with at least one recess, and wherein said apparatus further comprises a homing assembly for releasably holding said rotating support shaft at at least one preselected rotational position, said homing assembly comprising:

a sleeve member having first and second end portions and defining a coaxial hole therethrough whereby said second end portion of said sleeve member slidably receives and engages said first end portion of said support shaft so as to rotate with said support shaft; and at least one spring support member having a first end portion, secured to said sleeve member and an outboard end portion provided with cam feeler for rotatably engaging said camming surface of said cap member, said spring support member serving to bias said cam feeler toward said camming surface.

8. The rotational shelf apparatus of claim 7 wherein said camming surface of said cap member defines at least a pair of said recesses, and said homing assembly comprises at least a pair of said spring support members oppositely disposed upon said sleeve member, each said spring support member being provided with at least one recessed portion, and wherein said homing assembly further comprises a spring clamp having first and second outboard end portions said first outboard end portion releasably received in said recessed portion of one said spring support member and said second outboard end portion being received in said recessed portion of the other said spring support member so as to further spring bias said cam feelers of said spring support members toward said camming surface of said cap member.

9. The rotational shelf apparatus of claim 8 wherein each said spring support member is provided with a plurality of said recessed portions for receiving said outboard end portions of said spring clamp, said recessed portions being selectively spaced to allow for selective positioning of said spring clamp so as to selectively adjust the biasing force of said cam feelers.

10. The rotational shelf apparatus of claim 1 wherein said support structure comprises a shelf member mounted on said support shaft so as to rotate with said shaft.

11. The rotational shelf apparatus of claim 10 wherein said shelf member is provided with a collar member defining a coaxial hole therethrough slidably receptive of said support shaft, said collar member being provided with a hole threadably receptive of a set screw whereby said collar member is releasably secured to said support shaft by said set screw such that said shelf member may be selectively positioned along the axis of said support shaft.

12. The rotational shelf apparatus of claim 7 wherein said sleeve member is provided with a threaded hole proximate said second end portion of said sleeve member, said threaded hole being receptive of a set screw for releasably securing said sleeve member to said support shaft.

13. The rotational shelf apparatus of claim 10 wherein said apparatus is provided with at least a pair of said shelf members, each said shelf member comprising a forward edge for engaging a door panel, said door panel serving as a closure for said cabinet or other storage area.

14. The rotational shelf apparatus of claim 1 wherein said support structure comprises a hanger rack comprising an annular hanger rod provided with a plurality of spoke members for engaging a collar member, said collar member defining a hole therethrough slidably receptive of said support shaft, said collar member being provided with means for securing said collar member on said support shaft, such that said collar member and said hanger rod supported by said spoke members rotates with said support shaft.

15. The rotational shelf apparatus of claim 14 wherein said hanger rod comprises first and second end portions supportively secured to a door panel, said door panel serving as closure for said cabinet or other storage area, and wherein said door panel is provided with at least one yoke member for engaging said support shaft so as to further support said door panel.

16. A rotational shelf apparatus for being releasably mounted in a cabinet or other storage area, said cabinet or other area being provided with first and second oppositely disposed installation surfaces, said apparatus comprising:

a rotating support shaft having first and second end portions, said support shaft being provided with a coaxial hole at said first end portion defining a spring housing for slidably receiving a spring member, said spring member comprising first and second end portions, said second end portion of said support shaft comprising an outboard end portion having a decreasing cross sectional diameter circumferentially defining an arcuate engaging surface, said second end portion of said support shaft being further provided with means for rotatably engaging said second installation surface of said cabinet or other storage area, said means comprising a bearing member provided with a receptor for rotatably receiving said second end portion of said support shaft such that said support shaft is rotatably supported on said arcuate engaging surface, said bearing member being further provided with an engaging surface for releasably engaging said second installation surface, said engaging surface of said bearing member being provided with a plurality of engaging teeth for implanting in said second installation surface to hold said bearing member in a preselected position on said second installation surface;

a stationary support rod having first and second end portions, said second end portion of said support rod being slidably received in said hole in said first end portion of said support shaft in telescoping fashion such that said second end portion of said support rod releasably engages said first end portion of said spring member, said spring member serving to bias said support rod in the direction of said first installation surface of said cabinet or other storage area, said first end portion of said support rod being provided with means for releasably engaging said first installation surface of said cabinet, said means comprising a cap member mounted on said first end portion of said support rod, said cap member being provided with an engaging surface for releasably engaging said first installation surface, said engaging surface being provided with a plurality of engaging teeth for implanting in said first installation surface to hold said cap member in a preselected position on said first installation surface of said cabinet or other storage area, said cap member further comprising annular side walls defining a camming surface, said camming surface being provided with a pair of oppositely disposed recesses;

at least one support structure mounted on said rotating support shaft, said support structure comprising a shelf member secured to said support shaft so as to rotate with said support shaft; and a homing assembly for releasably holding said rotating support shaft at at least one preselected rotational position, said homing assembly comprising a sleeve member having first and second end portions and defining a coaxial hole therethrough whereby said second end portion of said sleeve member slidably receives and engages said first end portion of said support shaft so as to rotate with said support shaft, and further comprising a pair of oppositely disposed spring support members, each said spring support member having a first end portion secured to said sleeve member and an outboard end portion provided with a cam feeler for rotatably engaging said camming surface of said cap member, said spring support members serving to bias said cam feelers toward said camming surface of said cap member.

17. A rotational shelf apparatus for being releasably mounted in a cabinet or other storage area, said cabinet or other storage area being provided with first and second spaced apart and facing installation surfaces, said apparatus comprising:

a rotating support shaft having first and second end portions, said support shaft being provided with a coaxial hole beginning at said first end portion and terminating in a bottom surface proximate said second end portion, said hole defining a spring housing, said second end portion of said support shaft being provided with means for rotatably engaging said second installation surface of said cabinet or other storage area, said means comprising a bearing member provided with a receptor for rotatably receiving said second end portion of said support shaft, said bearing member also being provided with a plurality of engaging teeth for implanting in said second installation surfaces to hold said bearing member in a preselected position on said second installation surface;

a spring member slidably received in said hole, said spring member having first and second end portions, with said second end portion in contact with said bottom surface of said hole;

a stationary support rod having first and second end portions, said second end portion of said support rod being slidably received in said hole of said first end portion of said support shaft in telescoping fashion such that said second portion of said support rod releasably engages said first end portion of said spring member, said spring member serving to bias said support rod in the direction of sdid first installation surface of said cabinet or other storage area, said first end portion of said support rod being provided with means for releasably engaging said first installation surface; and at least one support structure mounted on said rotating support shaft.

18. The rotational shelf apparatus of claim 16 wherein each said spring support member is provided with at least one recessed portion, and wherein said homing assembly further comprises a spring clamp having first and second outboard end portions, said first outboard end portion releasably received in said recessed portion of one said spring support member and said second outboard end portion being received in said recessed portion of the other said spring support member so as to further spring bias said cam feelers of said spring support members toward said camming surface of said cap member.

19. The rotational shelf apparatus of claim 18 wherein each said spring support member is provided with a plurality of said recessed portions for receiving said outboard end portions of said spring clamp, said recessed portions being selectively spaced to allow for selective positioning of said spring clamp so as to selectively adjust the biasing force of said cam feelers.

* * * * *